US009970742B2

(12) United States Patent
McLean et al.

(10) Patent No.: US 9,970,742 B2
(45) Date of Patent: May 15, 2018

(54) ELECTRICAL PULSE SPLITTER FOR AN EXPLOSIVES SYSTEM

(71) Applicant: THE SECRETARY OF STATE FOR DEFENCE, Salisbury, Wiltshire (GB)

(72) Inventors: Stephen James McLean, Salisbury (GB); Gary John Searle, Salisbury (GB)

(73) Assignee: The Secretary of State for Defence, Salisbury, Wiltshire (GB)

( * ) Notice: Subject to any disclaimer, the term of this patent is extended or adjusted under 35 U.S.C. 154(b) by 0 days. days.

(21) Appl. No.: 14/394,764

(22) PCT Filed: Apr. 19, 2013

(86) PCT No.: PCT/GB2013/000173
§ 371 (c)(1),
(2) Date: Oct. 16, 2014

(87) PCT Pub. No.: WO2013/160641
PCT Pub. Date: Oct. 31, 2013

(65) Prior Publication Data

US 2015/0059608 A1 Mar. 5, 2015

(30) Foreign Application Priority Data

Apr. 26, 2012 (GB) ..... 1207450.6

(51) Int. Cl.
*F42D 1/055* (2006.01)
*F42B 12/16* (2006.01)
*F42C 11/06* (2006.01)

(52) U.S. Cl.
CPC ..... *F42D 1/055* (2013.01); *F42B 12/16* (2013.01); *F42C 11/06* (2013.01)

(58) Field of Classification Search
CPC ..... F42C 11/00; F42C 11/001; F42C 11/065; F42C 11/06; F42C 12/40; F42C 12/42;
(Continued)

(56) References Cited

U.S. PATENT DOCUMENTS 3,687,075 A * 8/1972 Fritz ..... F42D 1/055 102/312
3,700,971 A * 10/1972 Everest ..... G05B 19/063 361/250

(Continued)

FOREIGN PATENT DOCUMENTS

| | | |
|---|---|---|
| DE | 1513113 A1 | 8/1969 |
| IL | 118964 A | 7/2004 |
| WO | 200002005 A1 | 1/2000 |

OTHER PUBLICATIONS

International Search Report dated Jul. 22, 2013 in Application No. PCT/GB2013/000173

(Continued)

*Primary Examiner* — Derrick R Morgan
(74) *Attorney, Agent, or Firm* — Dean W. Russell; Kilpatrick Townsend & Stockton LLP

(57) ABSTRACT

There is provided an electrical pulse splitter (EPS) for an explosives system (10), the explosives system comprising an electrical pulse generator (EPG), the electrical pulse splitter (EPS), and first and second explosive charges (Ch1, Ch2) having respective first and second electrical initiators (D1, D2), The electrical pulse splitter (EPS) is configured to receive a primary electrical pulse from the electrical pulse generator (EPG), and to output first and second electrical pulses to the first and second electrical initiators (Ch1, Ch2) respectively. The second electrical pulse is output a length of time after the first electrical pulse is output, and the electrical pulse splitter is powered by the primary electrical pulse.

11 Claims, 2 Drawing Sheets

(58) Field of Classification Search
CPC . F42D 1/04; F42D 1/042; F42D 1/045; F42D 1/05; F42D 1/052; F42D 1/055; F42D 1/06
See application file for complete search history.

(56) References Cited

U.S. PATENT DOCUMENTS

| | | | | | |
|---|---|---|---|---|---|
| 3,808,459 | A * | 4/1974 | Guimier et al. | 377/127 | |
| 4,324,182 | A * | 4/1982 | Kirby et al. | 102/217 | |
| 4,375,192 | A * | 3/1983 | Yates et al. | 102/215 | |
| 4,387,649 | A * | 6/1983 | Weidner et al. | 102/215 | |
| 4,409,897 | A * | 10/1983 | Kirby | F42B 3/122 | 102/200 |
| 4,527,636 | A * | 7/1985 | Bordon | 175/4.55 | |
| 4,601,243 | A * | 7/1986 | Ueda et al. | 102/200 | |
| 4,674,047 | A * | 6/1987 | Tyler et al. | 89/28.05 | |
| 4,770,097 | A * | 9/1988 | Wilson et al. | 102/312 | |
| 4,825,765 | A * | 5/1989 | Ochi et al. | 102/206 | |
| 4,848,232 | A * | 7/1989 | Kurokawa et al. | 102/200 | |
| 5,069,129 | A * | 12/1991 | Kunitomo | F41A 19/65 | 102/200 |
| 5,117,756 | A * | 6/1992 | Goffin, II | 102/217 | |
| 5,214,236 | A * | 5/1993 | Murphy et al. | 102/217 | |
| 5,295,438 | A * | 3/1994 | Hill et al. | 102/217 | |
| 5,369,579 | A * | 11/1994 | Anderson | 702/11 | |
| 5,406,890 | A * | 4/1995 | Marsh | F42D 1/055 | 102/217 |
| 5,460,093 | A * | 10/1995 | Prinz | E21B 43/1185 | 102/215 |
| 5,517,920 | A * | 5/1996 | Hinz | F42D 1/055 | 102/202.4 |
| 5,520,114 | A * | 5/1996 | Guimard | F42D 1/055 | 102/206 |
| 5,520,115 | A * | 5/1996 | Braun | F42C 15/40 | 102/215 |
| 5,894,103 | A * | 4/1999 | Shann | 102/215 | |
| 5,964,815 | A * | 10/1999 | Wallace | B60R 21/01 | 180/282 |
| 6,000,338 | A * | 12/1999 | Shann | 102/217 | |
| 6,179,064 | B1 * | 1/2001 | Vaynshteyn | 175/4.54 | |
| 6,422,147 | B1 * | 7/2002 | Shann | 102/312 | |
| 6,584,907 | B2 * | 7/2003 | Boucher et al. | 102/217 | |
| 7,347,278 | B2 * | 3/2008 | Lerche | E21B 41/00 | 102/215 |
| 7,644,661 | B1 * | 1/2010 | Nelson et al. | 102/202.5 | |
| 7,752,970 | B2 * | 7/2010 | Nelson et al. | 102/215 | |
| 8,590,609 | B2 * | 11/2013 | Smithson | E21B 23/00 | 166/316 |
| 9,250,051 | B1 * | 2/2016 | Smith | F42D 1/05 | |
| 2003/0056678 | A1 * | 3/2003 | Griggs et al. | 102/202.1 | |
| 2003/0075069 | A1 * | 4/2003 | Boucher et al. | 102/217 | |
| 2005/0155509 | A1 * | 7/2005 | Matsuda et al. | 102/202.9 | |
| 2005/0247109 | A1 * | 11/2005 | Meyer et al. | 73/35.15 | |
| 2008/0098921 | A1 * | 5/2008 | Labuschagne et al. | 102/202.5 | |
| 2009/0314175 | A1 * | 12/2009 | Nelson et al. | 102/218 | |
| 2011/0056399 | A1 * | 3/2011 | Yan | F42B 3/122 | 102/215 |
| 2012/0167792 | A1 * | 7/2012 | Schlenter | F42D 1/055 | 102/217 |
| 2013/0036931 | A1 * | 2/2013 | Schlenter | 102/206 | |
| 2015/0040787 | A1 * | 2/2015 | Radojevic et al. | 102/210 | |
| 2016/0108720 | A1 * | 4/2016 | Teowee | E21B 47/06 | 73/1.15 |

OTHER PUBLICATIONS

Search Report dated Aug. 20, 2012 in Application No. GB1207450.6.

International Preliminary Report on Patentability dated Oct. 28, 2014 in Application No. PCT/GB2013/000173

Combined Search Report and Examination Report dated Sep. 19, 2013 in Application No. GB1307010.7.

* cited by examiner

ELECTRICAL PULSE SPLITTER FOR AN EXPLOSIVES SYSTEM

CROSS REFERENCE TO RELATED APPLICATIONS

This application is the U.S. national phase of International Application No. PCT/GB2013/000173 filed on Apr. 19, 2013, and published in English on Oct. 31, 2013 as International Publication No. WO 2013/160641 A1, which application claims priority to Great Britain Patent Application No, 1207450.6 filed on Apr. 26, 2012, the contents of both of which are incorporated herein by reference.

TECHNICAL FIELD OF THE INVENTION

This invention relates to an electrical pulse splitter for an explosives system, in particular an electrical pulse splitter for receiving a primary electrical pulse and outputting first and second electrical pulses.

BACKGROUND TO THE INVENTION

Known electrical explosive systems commonly comprise an electrical pulse generator, a length of cable connected to the electrical pulse generator, and an electrical initiator of an explosive charge connected to the length of cable.

Known explosive arrangements comprising two or more explosive charges may require one of the charges to be initiated before another one of the explosive charges. A tandem charge shell may comprise a shaped charge that is initiated to penetrate an object, and a secondary charge that is initiated a fixed time delay after the first charge has been initiated, for example as described in U.S. Pat. No. 5,198,615.

In an alternative situation, a set of demolition charges may be placed around a structure to be demolished with a requirement that one of the explosive charges is initiated before another of the explosive charges, to assure proper demolition of the structure.

Timing delays between initiations of explosive charges may be implemented using variable lengths of fuze, although, the accuracy of the time delay provided by variable lengths of fuze is fairly low.

A known method for electrically initiating a secondary charge of a tandem warhead comprises the use of a piezoelectric material that becomes compressed as a result of a primary charge being initiated, and generates an electrical pulse that initiates the secondary charge. However, the time at which the primary charge is initiated is determined by impact of the warhead with an object, and the length of time until the secondary charge is initiated is short and not well-defined.

Another known method for demolition charges is to use a sequenced electrical pulse generator that sends an electric pulse to one output connected to one explosive charge, and a slightly later electric pulse to another output having another explosive charge. However, then multiple long lengths of cable are required to go between the sequenced electrical pulse generator and the explosive charges; specifically one long length of cable (e.g. 50 m) for each explosive charge that is used. Furthermore, each output must transmit a large enough electric pulse to traverse the length of the cable and still have sufficient energy remaining to initiate the explosive charge. A sequenced electrical pulse generator cannot be simply incorporated into an explosive charge system due to the inherent danger of having a source of electrical energy in close proximity to explosives.

It is therefore an aim of the invention to improve upon the known art.

SUMMARY OF THE INVENTION

According to an embodiment of the invention, there is provided an electrical pulse splitter for an explosives system, the explosives system comprising an electrical pulse generator, the electrical pulse splitter, and first and second explosive charges having respective first and second electrical initiators, wherein the electrical pulse splitter is configured to receive a primary electrical pulse from the electrical pulse generator, and to output first and second electrical pulses to the first and second electrical initiators respectively, the second electrical pulse being output a length of time after the first electrical pulse is output, the electrical pulse splitter being powered by the primary electrical pulse.

Since the electrical pulse splitter is powered by the primary electrical pulse, there is no need for a power source to be incorporated as part of the electrical pulse splitter. Preferably, the electrical pulse splitter is powered only by the primary electrical pulse to improve the safety of the electrical pulse splitter.

The electrical pulse splitter may be connectable to the electrical pulse generator by a primary cable for transmitting the primary electrical pulse, and may be connectable to the first electrical initiator by a first cable for transmitting the first electrical pulse, and connectable to the second electrical initiator by a second cable for transmitting the second electrical pulse. The length of the primary cable is typically much longer than the length of each one of the first and second cables, for example the length of the primary cable may be at least 10 times the length of the longest one of the first and second cables.

The electrical pulse splitter may be configured to output a first portion of the primary electrical pulse as the first electrical pulse, and a second portion of the primary electrical pulse as the second electrical pulse. The first and second portions of the primary electric pulse may be sequential in time with the first portion being before the second portion or the second portion being before the first portion, or the first and second portions may overlap one another in time.

Accordingly, only one primary electric pulse needs to be sent down the primary cable in order to initiate both the first and second explosive charges. This is more energy efficient than sending two separate pulses down two separate cables to initiate two respective explosive charges, as is done when using the hereinbefore described known sequenced electrical pulse generator. In particular, the pulse energy losses along the primary cable only occur once, instead of twice as with the known sequenced electrical pulse generator. Accordingly a battery-powered electrical pulse generator used in accordance with an embodiment of the invention may be capable of initiating many more charges before the battery is extinguished than if it were used in the manner of a known sequenced electrical pulse generator with a tong separate cable for each explosive charge.

The electrical pulse splitter may comprise a storage capacitance configured to store the second portion of the primary electrical pulse, and to output the stored second portion as the second electrical pulse. The electrical pulse splitter may also comprise a power storage capacitance configured to store electrical energy of the primary electrical pulse for powering the electrical pulse splitter. Other forms of charge storage may be possible, but capacitive charge storage is preferred since capacitors typically have high self-discharge rates compared to other forms of charge storage, so that they can be considered safe for storage with explosives. The storage capacitance may be the same capacitance as the power storage capacitance.

The second electrical pulse is output a length of time after the first electrical pulse is output. The length of time between the electrical pulse outputs may for example be defined with respect to the starts of the electrical pulse outputs, or with respect to the times when the electrical pulse outputs each reach their maximum output voltages.

The electrical pulse splitter may comprise a controller that controls the output times of the first and second electrical pulses, the controller being powered by the primary electrical pulse. The use of a controller to determine the length of time enables the time between initiation of the first and second explosive charges to be accurately controlled. The controller may be initially powered by the primary electrical pulse, and subsequently powered by at least one capacitor that has been charged by the primary electrical pulse.

Advantageously, the length of time may be a predetermined length of time which is fixed prior to receiving the primary electrical pulse. Then, the length of time may be accurately fixed at a desired value. Alternatively, the length of time may be at least partially determined by an event occurring after the detonation of the first explosive charge, for example as a result of a signal from an accelerometer or a light meter. The event is typically an event that occurs as a result of the detonation of the first explosive charge. Accordingly, if for some unintended reason the first explosive charge does not initiate, then the second charge will not be initiated either.

The length of time may be determined to be the time after which both a sensor connected to the controller indicates a given event, and a predetermined length of time has elapsed.

The electrical pulse splitter may comprise a timer for determining when the length of time has elapsed.

Typically, the electrical pulse splitter is housed separately from the electrical pulse generator so that the electrical pulse splitter can be stored together with the explosive charges or integrated within a tandem warhead. Then, the electrical pulse generator can be stored in a different location safely away from the explosive charges.

Those skilled in the art will appreciate that the electrical pulse splitter may provide more than two outputs, for example three outputs with the third electrical pulse output following a certain length of time after the output of the second electrical pulse output.

Each electrical initiator of an explosive charge receives electrical energy and initiates the explosive. The electrical initiator may be example be an electrically initiated detonator that detonates to initiate the explosive.

According to another embodiment of the invention, there is provided an explosives system comprising an electrical pulse generator, an electrical pulse splitter, and first and second explosive charges having respective first and second electrical initiators, wherein the electrical pulse splitter is configured to receive a primary electrical pulse from the electrical pulse generator, and to output first and second electrical pulses to the first and second electrical initiators respectively, the second electrical pulse being output a length of time after the first electrical pulse is output, the electrical pulse splitter being powered only by the primary electrical pulse.

According to yet another embodiment of the invention, there is provided a method within an electrical pulse splitter for an explosives system. The method comprises:

receiving a primary electrical pulse;

powering the electrical pulse splitter with the primary electrical pulse;

outputting a first portion of the primary electrical pulse as a first electrical pulse at a first output;

outputting a second portion of the primary electrical pulse as a second electrical pulse at a second output;

wherein the second electrical pulse is output a length of time after the first electrical pulse is output.

Advantageously, the second portion of the primary electrical pulse may be stored prior to the outputting of the first portion of the primary electrical pulse. Accordingly, the second portion may be an initially received part of the primary electrical pulse, and the first portion may be a subsequently received part of the primary electrical pulse. Storing the initially received part of the primary electrical pulse ensures that enough electrical energy has been stored to generate the second electrical pulse at a later time before starting to output the first electrical pulse.

BRIEF DESCRIPTION OF THE DRAWINGS

Embodiments of the invention will now be described by way of example only and with reference to the accompanying drawings, in which.

DETAILED DESCRIPTION

Figure 1:
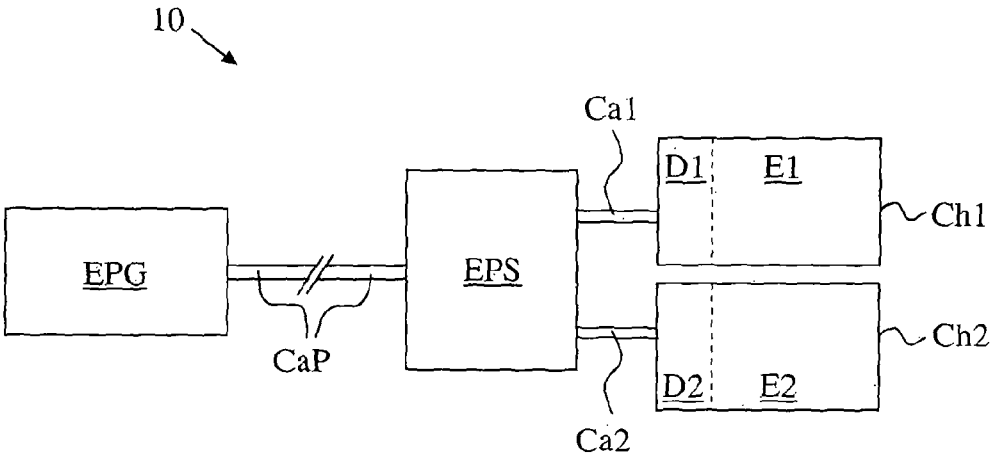
FIG. 1 shows a schematic diagram of an explosives system according to an embodiment of the invention, the explosives system comprising an electrical pulse splitter.

The schematic diagram of FIG. 1 shows an explosives system 10 according to an embodiment of the invention. The explosives system 10 comprises an electrical pulse generator EPG that is connected to an electrical pulse splitter EPS by a primary cable CaP. The electrical pulse splitter EPS is connected to a first electrically initiated detonator D1 of a first explosive charge Ch1 by a first, cable C1, and is also connected to a second electrically initiated detonator D2 of a second explosive charge Ch2 by a second cable C2. The explosive charges Ch1 and Ch2 Comprise explosives material E1 and E2 respectively.

In operation, the electrical pulse generator EPG is triggered and sends out a primary electrical pulse to the electrical pulse splitter EPS along the primary cable CaP. The electrical pulse splitter EPS outputs a first electrical pulse along the first cable Ca1 to detonate the first explosive charge Ch1, and then outputs a second electrical pulse along the second cable Ca2 to detonate the second explosive charge Ch2. The electrical pulse splitter EPS is powered only by the primary electrical pulse.

Various suitable electrical pulse generators, cables, and electrical initiators will be apparent to those skilled in the art. For example, the electrical pulse generator may be a Shrike MKV L3A3 (a commercially-available device which provides direct current [DC] pulses), the primary, first and second cables may be standard twisted brown and black firing cables, and the first and second electrically initiated detonators may for example be L2A2 electric detonators. Explosives materials such as PETN may be used for the explosive materials E1 and E2. The use of alternate elements is obviously also possible, for example the use of shock tube cables instead of twisted brown and black cables.

Figure 2:
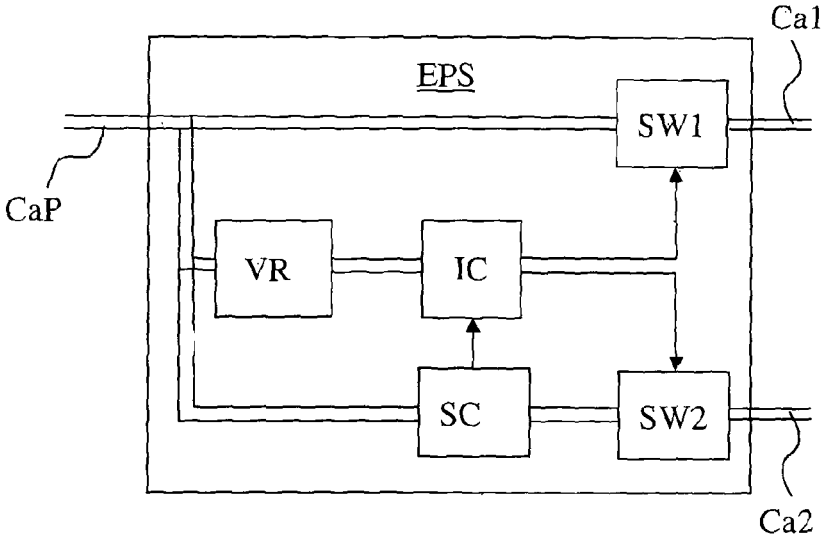
FIG. 2 shows a block diagram of an electrical pulse splitter suitable for use in the explosives system of FIG. 1.

The block diagram of FIG. 2 shows one example of an electrical pulse splitter EPS suitable for use in the FIG. 1 embodiment. The electrical pulse splitter comprises an input connection to the primary cable CaP from the electrical pulse generator EPG, and the input connection feeds into a voltage regulator VR, a first switch SW1, and a storage capacitor SC. The voltage regulator is connected to the power input of an integrated circuit IC controller, and the integrated circuit IC receives a monitor input from the storage capacitor, and outputs first and second switch control outputs to first SW1 and second SW2 switches respectively.

The voltage regulator VR receives the primary input pulse and outputs a regulated voltage (e.g. 5V) to power the integrated circuit IC. The integrated circuit monitors the voltage of the storage capacitors SC, and determines when the switches SW1 and SW2 are to be closed. For safety reasons the switches SW1 and SW2 are normally open switches, so that no power can flow into the cables Ca1 or Ca2 until the integrated circuit commands it.

Figure 3:
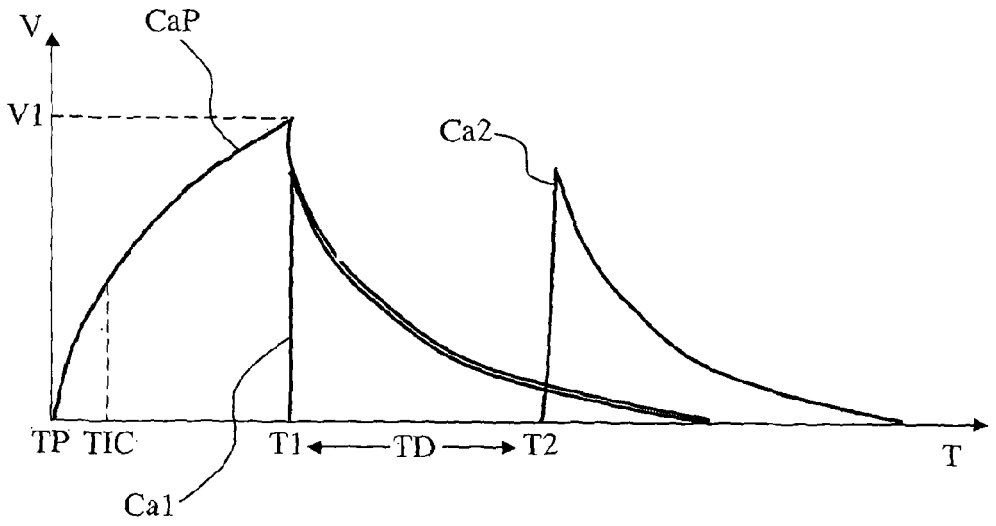
FIG. 3 shows a schematic timing diagram of primary, first, and second electrical pulse voltages of the electrical pulse splitter of FIG. 2 upon triggering the electrical pulse generator.

The operation of the electrical pulse splitter circuit of FIG. 2 will now be explained with reference to the timing diagram of FIG. 3. The timing diagram is purely schematic and is not intended to depict any particular timescales or voltage levels. FIG. 3 shows the voltages present on the primary, first, and second cables after the electrical pulse generator EPG is triggered at time TP to send an electrical pulse.

Firstly, the electrical pulse splitter EPS begins to receive the electrical pulse as an input from the cable CaP at time TP, and once the voltage of the pulse has built up sufficiently the voltage regulator VR supplies a regulated voltage to power up the integrated circuit IC at time TIC. The electrical pulse input also begins to charge the storage capacitors SC.

Once the storage capacitors reach a threshold voltage V1 at time T1, a timing circuit of the integrated circuit IC begins timing and the integrated circuit IC closes the switch SW1. This closing of the SW1 switch connects the electrical pulse input from the primary cable CaP to the first cable Ca1, thereby initiating the detonator D1 and the explosive material E1.

Once the timing circuit of the integrated circuit determines that a predetermined length of time TD has lapsed from closing the switch SW1, the integrated circuit closes the switch SW2 at time T2. Closing the switch SW2 releases the charge stored in the storage capacitors SC into the second cable Ca2, thereby initiating the detonator D2 and explosive material E2.

The voltage levels in the primary, first, and second cables reduce towards zero, and once the voltage of the power storage capacitor of the voltage regulator falls below a critical level the integrated circuit powers down and the switches SW1 and SW2 return to being open.

During the predetermined length of time TD the electrical pulse input falls towards zero, although the voltage regulator comprises a sufficiently large power storage capacitor to keep the integrated circuit IC powered until after the predetermined time has elapsed.

The storage capacitors are preferably charged through a diode, to prevent stored charge from flowing out through SW1 or back along the cable CaP after the electrical pulse input has diminished below the capacitor voltage.

Optionally, an input rectifier (not shown in FIGS.) such as a diode bridge rectifier may be placed between the primary cable CaP input and the voltage rectifier VR and switches SW1 and SW2 to help assure positive and negative electrical pulse input lines and remove any zero-crossings of the primary electrical pulse input that may occur dependent upon the characteristics of the electrical pulse generator.

In this embodiment, the time delay TD is set within the IC at the required value for the particular use for which the electrical pulse splitter is intended. Alternatively, the time delay TD may be externally adjustable, for example via a user interface such as a keypad.

Furthermore, in some embodiments the time delay TD may be set or augmented by information from an external sensor connected to the integrated circuit. For example, the time delay TD may be determined to be over once a certain signal from a sensor has been received, for example a signal from an accelerometer indicating that the first explosive charge has been detonated, or a signal from a light sensor indicating that the sensor is above or below ground (light or dark).

It would be a simple matter to add a third (or subsequent) output for outputting third (or subsequent) electrical pulses froth the electrical pulse splitter and certain times relative to the output times of one or more of the other electrical pulses. For example, another switch and corresponding storage capacitor the same as the switch SW2 and the storage capacitor SC could easily be connected into the system of FIG. 2.

Figure 4:
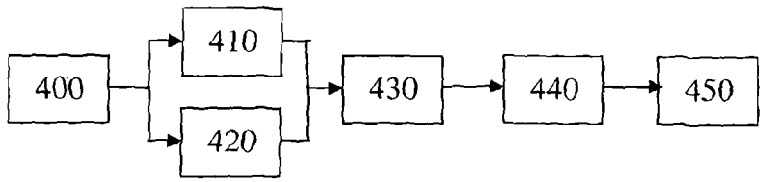
FIG. 4 shows a flow diagram of a method within an electrical pulse splitter according to an embodiment of the invention.

The flow diagram of FIG. 4 shows a method within an electrical pulse splitter according to an embodiment of the invention.

At step 400, the electrical pulse splitter receives a primary electric pulse, for example from the electrical pulse generator EPG of FIG. 1.

At step 410 the electrical pulse splitter is powered by the electrical pulse, for example turning on a controller like the integrated circuit IC of FIG. 2 to control the switches SW1 and SW2.

At step 420, the incoming primary electrical pulse energy is stored, for example in a capacitor. This storage occurs concurrently with the powering up of the electrical pulse splitter in step 410.

By step 430, sufficient energy has been stored and so the incoming primary electrical pulse energy is diverted to a first output as a first electrical pulse. The first electrical pulse may initiate a detonator of a first explosive charge.

After a length of time has elapsed from step 430, at step 440 the stored primary electrical pulse energy is output as a second electrical pulse at a second output. The second electrical pulse may initiate a detonator of a second explosive charge.

Finally, at step 450 substantially all of the electrical energy of the primary electrical pulse has been dissipated, and the electrical pulse splitter returns to a dormant state until another primary electrical pulse is received.

Various alternate embodiments of the invention falling within the scope of the appended claims will be apparent to those skilled in the art.

The invention claimed is:

1. An electrical pulse splitter for communicating with first and second electrical initiators in an explosives system, wherein the electrical pulse splitter is provided with only a single input connection configured to receive only a direct current primary electrical pulse, the electrical pulse splitter is further provided with a first output cable configured to transmit only a first electrical pulse to the first electrical initiator, and a second output cable configured to transmit only a second electrical pulse to the second electrical initiator, the first and second electrical pulses being portions of the direct current primary electrical pulse and the second electrical pulse being output a length of time after the first electrical pulse is output, the electrical pulse splitter comprising a controller (a) powered only by the direct current primary electrical pulse and (b) controlling output times of the first and second electrical pulses, and the electrical pulse splitter being positioned in use proximate the first and second electrical initiators.

2. An electrical pulse splitter according to claim 1, wherein the electrical pulse splitter is configured to be connected to a direct current electrical pulse generator by a primary cable for transmitting the primary electrical pulse.

3. An electrical pulse splitter of claim 1, wherein the electrical pulse splitter comprises a storage capacitance configured to store a portion of the direct current primary electrical pulse, and to output the stored portion as the second electrical pulse.

4. An electrical pulse splitter of claim 1, wherein the electrical pulse splitter comprises a power storage capacitance configured to store electrical energy of the direct current primary electrical pulse for powering the electrical pulse splitter.

5. An electrical pulse splitter of claim 1, wherein the length of time is a predetermined length of time, the predetermined length of time being determined prior to receiving the direct current primary electrical pulse.

6. An electrical pulse splitter of claim 1, wherein the electrical pulse splitter comprises a timer for determining when the length of time has elapsed.

7. An electrical pulse splitter of claim 1, wherein the length of time is determined to have elapsed when a sensor connected to the controller indicates a given event.

8. An electrical pulse splitter of claim 1, wherein the length of time is determined to have elapsed when both a sensor connected to the controller indicates a given event, and a predetermined length of time has elapsed.

9. A method of sequentially initiating first and second explosive charges of a system including an electrical pulse generator and an electrical pulse splitter (i) provided with only a single input connection, the single input connection being connected to the electrical pulse generator, (ii) provided with first and second output cables respectively connected to the first and second explosive charges, (iii) located remote from the pulse generator and proximate the first and second explosive charges, and (iv) comprising a controller, the method comprising:

a. generating a primary electrical pulse using the electrical pulse generator;

b. powering the controller of the electrical pulse splitter using only the primary electrical pulse;

c. outputting a first electrical pulse from the electrical pulse splitter so as to detonate only the first explosive charge, the first electrical pulse being a portion of the primary electrical pulse;

d. outputting a second electrical pulse from the electrical pulse splitter so as to detonate only the second explosive charge, the second electrical pulse being a portion of the primary electrical pulse; and e. controlling output times of the first and second electrical pulses using the controller.

10. An explosives system comprising:

a. an electrical pulse generator configured to generate a direct current primary electrical pulse;

b. an electrical pulse splitter (i) having only a single input connection, the single input connection being configured to receive only the primary electrical pulse, (ii) located remote from the electrical pulse generator, (iii) comprising a controller powered only by the primary electrical pulse, and (iv) configured to output a first electrical pulse and a second electrical pulse, the first and second electrical pulses being portions of the primary electrical pulse and the second electrical pulse being output a length of time after the first electrical pulse as controlled by the controller;

c. a primary cable connected to the electrical pulse generator and the electrical pulse splitter so as to convey the primary electrical pulse from the electrical pulse generator to the electrical pulse splitter;

d. a first explosive charge comprising a first detonator proximate the electrical pulse splitter;

e. a second explosive charge comprising a second detonator proximate the electrical pulse splitter;

f. a first cable (i) connected to the electrical pulse splitter and the first detonator so as to convey the first electrical pulse from the electrical pulse splitter to the first detonator and (ii) not connected to the second detonator; and g. a second cable (i) connected to the electrical pulse splitter and the second detonator so as to convey the second electrical pulse from the electrical pulse splitter to the second detonator and (ii) not connected to the first detonator.

11. An electrical pulse splitter of claim 1, wherein the electrical pulse splitter comprises means for storing a portion of the direct current primary electrical pulse and outputting the stored portion as the second electrical pulse.

* * * * *